US011421514B2

(12) United States Patent
Harrigan et al.

(10) Patent No.: US 11,421,514 B2
(45) Date of Patent: Aug. 23, 2022

(54) COHESIVELY ENHANCED MODULAR PERFORATING GUN

(71) Applicant: Schlumberger Technology Corporation, Sugar Land, TX (US)

(72) Inventors: Edward Harrigan, Richmond, TX (US); Hao Liu, Missouri City, TX (US); Vinod Chakka, Pune (IN); Richard Warns, Sugar Land, TX (US); Pedro Hernandez, Sugar Land, TX (US); Raphael Rogman, Houston, TX (US); Allan Goldberg, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/888,882

(22) PCT Filed: May 2, 2014

(86) PCT No.: PCT/US2014/036541
§ 371 (c)(1),
(2) Date: Nov. 3, 2015

(87) PCT Pub. No.: WO2014/179669
PCT Pub. Date: Nov. 6, 2014

(65) Prior Publication Data

US 2016/0084048 A1 Mar. 24, 2016

Related U.S. Application Data

(60) Provisional application No. 61/819,196, filed on May 3, 2013.

(51) Int. Cl.
*E21B 43/1185* (2006.01)
*E21B 43/119* (2006.01)
*E21B 43/117* (2006.01)

(52) U.S. Cl.
CPC ..... *E21B 43/1185* (2013.01); *E21B 43/117* (2013.01); *E21B 43/119* (2013.01)

(58) Field of Classification Search
CPC ..... E21B 43/11; E21B 43/1185
See application file for complete search history.

(56) References Cited

U.S. PATENT DOCUMENTS 2,062,974 A * 12/1936 Lane ..... E21B 43/116 102/480
2,252,270 A * 8/1941 Miller ..... E21B 43/1185 175/4.55

(Continued)

FOREIGN PATENT DOCUMENTS

CA 2532088 C * 7/2009
CA 3044516 A1 7/2018

(Continued)

OTHER PUBLICATIONS

Merriam-Webster Dictionary, multiple various definitions for the term "bulkhead", published in Jan. 2013. (Year: 2013).*

(Continued)

*Primary Examiner* — Jonathan Malikasim
(74) *Attorney, Agent, or Firm* — Rodney Warfford

(57) ABSTRACT

Embodiments may take the form of a perforating gun of modular assembly. The perforating gun may include at least one centralizing member at an interface between a loading tube and a carrier. Among modular components, the gun may also include an initiator assembly module that is electrically coupled to a modular feedthrough with a connector. The insert and the centralizing member may enhance axial cohesiveness of the modular gun. A shock absorbing mount may be located within the carrier and may receiving the initiator assembly module to provide added axial cohesiveness to the modular gun.

23 Claims, 5 Drawing Sheets

(56) References Cited

U.S. PATENT DOCUMENTS 3,173,992 A * 3/1965 Boop ..... H01B 17/306 102/202.9
3,836,843 A * 9/1974 Yonce ..... H01R 13/717 324/504
4,004,643 A * 1/1977 Newman ..... E21B 17/02 166/66.5
4,191,265 A 3/1980 Bosse-Platiere
4,296,481 A * 10/1981 Weiss ..... G01V 13/00 174/101.5
4,519,313 A 5/1985 Leidel
4,619,333 A * 10/1986 George ..... E21B 43/116 166/297
4,759,291 A * 7/1988 Barker ..... E21B 43/116 102/202.5
4,850,438 A 7/1989 Regalbuto
4,909,320 A * 3/1990 Hebert ..... E21B 29/02 166/361
5,007,486 A * 4/1991 Rides ..... E21B 43/117 102/310
5,756,926 A 5/1998 Bonbrake et al.
6,082,265 A 7/2000 Sakamoto et al.
6,311,621 B1 11/2001 Marshall et al.
6,412,338 B2 7/2002 Boyle et al.
6,412,388 B1 * 7/2002 Frazier ..... E21B 43/117 102/312
6,412,415 B1 * 7/2002 Kothari ..... E21B 43/116 102/312
6,655,289 B1 12/2003 Bornheim et al.
6,752,083 B1 6/2004 Lerche et al.
7,347,278 B2 3/2008 Lerche et al.
7,762,331 B2 * 7/2010 Goodman ..... E21B 43/117 166/299
8,056,632 B2 11/2011 Soodman
8,113,119 B2 * 2/2012 Crawford ..... F42D 5/00 102/313
8,256,337 B2 * 9/2012 Hill ..... E21B 43/1185 89/1.15
8,408,132 B2 4/2013 Lucas et al.
8,596,378 B2 12/2013 Mason et al.
8,943,943 B2 * 2/2015 Tassaroli ..... E21B 43/119 175/4.55
9,115,572 B1 8/2015 Hardesty et al.
9,494,021 B2 11/2016 Parks et al.
9,581,422 B2 2/2017 Preiss et al.
9,605,937 B2 3/2017 Eitschberger et al.
9,702,680 B2 7/2017 Parks et al.
9,903,185 B2 2/2018 Ursi et al.
10,188,990 B2 1/2019 Burmeister et al.
10,190,398 B2 1/2019 Goodman et al.
10,273,788 B2 4/2019 Bradley et al.
10,338,030 B2 * 7/2019 Bittar ..... G01N 27/82
10,458,213 B1 10/2019 Eitschberger et al.
11,293,737 B2 * 4/2022 Sullivan ..... F42D 1/05
2004/0216866 A1 * 11/2004 Barlow ..... E21B 43/119 166/55
2005/0211467 A1 9/2005 Ratanasirigulchia et al.
2009/0151589 A1 * 6/2009 Henderson ..... E21B 17/07 102/333
2009/0159285 A1 6/2009 Goodman
2010/0005992 A1 1/2010 Crawford
2010/0011945 A1 1/2010 Loehr
2010/0024674 A1 2/2010 Peeters et al.
2011/0024116 A1 2/2011 McCann et al.
2012/0018157 A1 1/2012 Gill et al.
2012/0138286 A1 6/2012 Mason et al.
2012/0152542 A1 * 6/2012 Le ..... E21B 47/01 166/297
2012/0180678 A1 * 7/2012 Kneisl ..... F42D 1/055 102/202.7
2012/0199352 A1 * 8/2012 Lanclos ..... E21B 43/1185 166/297
2012/0247769 A1 10/2012 Schacherer et al.
2012/0247771 A1 10/2012 Black et al.
2013/0043074 A1 * 2/2013 Tassaroli ..... E21B 43/1185 175/2
2013/0048376 A1 * 2/2013 Rodgers ..... E21B 43/1195 175/4.6
2013/0153205 A1 * 6/2013 Borgfeld ..... H01R 13/5833 166/55
2014/0338552 A1 11/2014 Mace et al.
2015/0330192 A1 11/2015 Rogman et al.
2016/0168961 A1 6/2016 Parks et al.
2016/0356132 A1 12/2016 Burmeister et al.
2017/0052011 A1 2/2017 Parks et al.
2017/0176152 A1 6/2017 Goodman
2017/0211363 A1 7/2017 Bradley et al.
2017/0275976 A1 9/2017 Collins et al.
2018/0299239 A1 10/2018 Eitschberger et al.
2018/0306010 A1 10/2018 Von Kaenel et al.
2019/0040722 A1 2/2019 Yang et al.
2019/0186241 A1 6/2019 Yang et al.
2019/0195054 A1 6/2019 Bradley et al.
2019/0257181 A1 8/2019 Langford et al.
2019/0292887 A1 9/2019 David et al.
2019/0353013 A1 11/2019 Sokolove et al.
2020/0018139 A1 1/2020 Eitschberger et al.
2020/0024934 A1 1/2020 Eitschberger et al.
2020/0024935 A1 1/2020 Eitschberger et al.
2020/0048996 A1 2/2020 Anthony et al.
2020/0072029 A1 3/2020 Anthony et al.
2020/0256167 A1 8/2020 Gupta et al.

FOREIGN PATENT DOCUMENTS

CN 2244095 1/1997
CN 101575965 A 11/2009
EP 132330 A2 1/1985
EP 0175439 A2 3/1986
EP 0601880 A2 6/1994
EP 0919694 A2 6/1999
EP 1930541 A2 6/2008
RU 121054 U1 10/2012
RU 2561828 C2 9/2015
WO 2001096807 A2 12/2001
WO 2012135101 A2 10/2012
WO 2013180765 A1 12/2013
WO 2014089194 A1 6/2014
WO 2014179669 A1 11/2014
WO 2018026952 A1 2/2018
WO 2020232242 A1 11/2020

OTHER PUBLICATIONS

PCT/US2013/073094, International Search Report and Written Opinion, dated Mar. 20, 2014, 9pgs.
International Search Report and the Written Opinion for International Application No. PCT/US2014/036541 dated Sep. 12, 2014.
International Search Report and Written Opinion issued in the related PCT application PCT/US2013/073094, dated Mar. 20, 2014 (9 pages).
International Preliminary Reporton Patentability issued in the related PCT application PCT/US2013/073094, dated Jun. 9, 2015 (5 pages).
European Search Report issued in the related EP application 13860417.8, dated Feb. 22, 2016 (6 pages).
Communication article 94-3 issued in the related EP application 13860417.8, dated Mar. 9, 2016 (6 pages).
Office action issued in the related CN application 201380062953.4, dated Sep. 1, 2016 (22 pages).
Office action issued in the related RU application 2015126872, dated Aug. 19, 2016 (8 pages).
Decision of Grant issued in the related RU application 2015126872, dated Dec. 1, 2016 (12 pages).
Communication article 94-3 issued in the related EP application 13860417.8, dated Mar. 8, 2017 (6 pages).
International Preliminary Report on Patentability issued in the related PCT application PCT/US2014/036541, dated Nov. 3, 2015 (09 pages).
Office action issued in the related CN application 201380062953.4, dated Jun. 15, 2017 (20 pages).

(56) References Cited

OTHER PUBLICATIONS

Communication article 94-3 issued in the related EP application 13860417.8, dated Jan. 19, 2018 (5 pages).
Office action issued in the related CN application 201380062953.4, dated Feb. 27, 2018 (11 pages).
Exam Report issued in the related CA Application 2892378 dated Nov. 15, 2019, 4 pages.
Office Action issued in the related U.S. Appl. No. 16/021,061 dated Apr. 20, 2020, 20 pages.
Exam Report issued in the related AR Patent Application No. 20140101829 dated Apr. 16, 2020, 5 pages.
Office Action issued in the related U.S. Appl. No. 16/021,061 dated Sep. 9, 2020, 11 pages.
English translation of Exam Report issued in the related AR Patent Application No. 20140101829, dated Aug. 30, 2021, 2 pages.
H-2 Perforating System, Titan division, 2019 (1 page).
International Preliminary Report on Patentability issued in the PCT Application PCT/US2020/017262 dated Aug. 19, 2021, 11 pages.
International Preliminary Report on Patentability issued in the PCT Application PCT/US2020/032879 dated Nov. 25, 2021, 8 pages.
International Search Report and Written Opinion issued in the PCT Application PCT/US2020/017262 dated Jun. 19, 2020, 13 pages.
International Search Report and Written Opinion issued in the PCT Application PCT/US2020/032879, dated Aug. 28, 2020 (10 pages).
Notice of Allowance issued in U.S. Appl. No. 16/021,061 dated Aug. 11, 2021, 8 pages.
Titan H2 Perforating Gun System, (2019) 2 pages, Link: https://www.oilfieldtechnology.com/product-news/07022019/hunting-introduces-h-2-perforating-system/.
Office Action issued in U.S. Appl. No. 17/235,616 dated Mar. 16, 2022.

* cited by examiner

COHESIVELY ENHANCED MODULAR PERFORATING GUN

PRIORITY CLAIM/CROSS REFERENCE TO RELATED APPLICATION(S)

This Patent Document claims priority under 35 U.S.C. § 119 to U.S. Provisional App. Ser. No. 61/819,196, filed May 3, 2013, and entitled, "Perforating Gun with Integrated Initiator", which is incorporated herein by reference in its entirety.

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. As a result, perforations may be formed into the surrounding formation, ultimately enhancing recovery therefrom.

The described manner of perforating requires first that the perforating gun be loaded with a number of shaped charges that provide the energy to form the noted perforation. Specifically, an explosive pellet of compressed material is provided in a casing and may be individually loaded into the gun as a shaped charge. Thus, once detonated, each shaped charge may perform similar to a ballistic jet in forming an adjacent perforation. Further, this manner of operation is enhanced by a liner that is placed over the explosive pellet. That is, the pellet is secured within the cavity of a casing and provided with a liner thereover so as to enhance and tailor the performance of the fully assembled shaped charge.

Unfortunately, while fairly safe and effective for use downhole in the well, transporting a fully armed gun loaded with a detonator and shaped charges to an operator at an oilfield is not an option. Indeed, as a matter of ensuring safe transport, governmental bodies, such as the department of transportation (DOT) in the United States, understandably do not allow the transporting of such an assembly unless it is modified, for example with a cumbersome ballistic interrupt. More likely, components of the unarmed gun and detonator are separately delivered to the oilfield location where assembly may be completed prior to deployment of the gun into the well.

Arming and fully assembling a perforating gun with a detonator at the oilfield may be a time consuming and largely inexact undertaking. For example, shaped charges may be assembled and/or loaded into a loading tube that accommodates a host of charges and is then inserted into a carrier of the gun. However, even the loaded gun remains incomplete. That is, as a matter of added precaution, an initiator that regulates firing of the gun is generally not effectively wired to the gun until all required components are present and assembled.

The initiator is a circuit-based device that is configured to detect an operator's command from the oilfield surface in order to allow detonation of the shaped charges within the gun. Thus, in order to keep the gun less than fully armed, it may be provided at the oilfield without the initiator but with an exposed port where the initiator is to be added. At this location, wiring in a downhole direction to an internal detonator may be found as well as wiring that runs in an uphole direction for sake of conveying operator commands. As a practical matter, this means that a host of different wires are manually connected to corresponding connections or wires of the initiator by hand as the port of the gun remains open to the oilfield surface environment.

Not only is this type of assembly time consuming as noted above, there remains the possibility of mis-wiring, debris getting into the gun, or even improper sealing and/or capping off of the initiator once the connections have been made. Indeed, it is estimated that a majority of perforating application misruns may be linked directly to such wiring related issues. This may be attributable to human error or simply the inherent lack of cohesiveness involved where multiple electrical connections are made at the oilfield. Whatever the case, a degree of reliability is compromised, in order to ensure an acceptable level safety.

SUMMARY

A modular perforating gun is disclosed for perforating a formation in a well. The gun includes a tubular carrier with a loading tube therein. The loading tube includes a shock absorbing mount with shaped charges to one side of the mount and an initiator assembly module at an opposite side thereof. The initiator assembly module is configured to trigger the charges for the perforating. Further, at least one centralizing member is disposed about the loading tube to provide a secure interface between the tubular carrier and the loading tube. In one embodiment, a modular feedthrough assembly is also provided that securably receives an electrical connector of the initiator assembly at an interface therebetween. Thus, coupling between the connector and feedthrough assembly may be enhanced.

DETAILED DESCRIPTION

Embodiments are described with reference to certain perforating applications. For example, in embodiments shown, a single wireline conveyed perforating gun is delivered to a vertical well for a perforating application. However, in other embodiments, the gun may be conveyed by alternate means, incorporated into more permanent hardware, provided in series or a host of other operational types. Regardless, so long as the perforating gun is modular in nature with certain structurally and/or electrically stabilizing features as detailed herein, appreciable benefit may be realized. Specifically, such features may render a modular form of assembled perforating gun both user-friendly and practically reliable for the environment of a downhole perforating application and transport thereto.

Figure 1A:
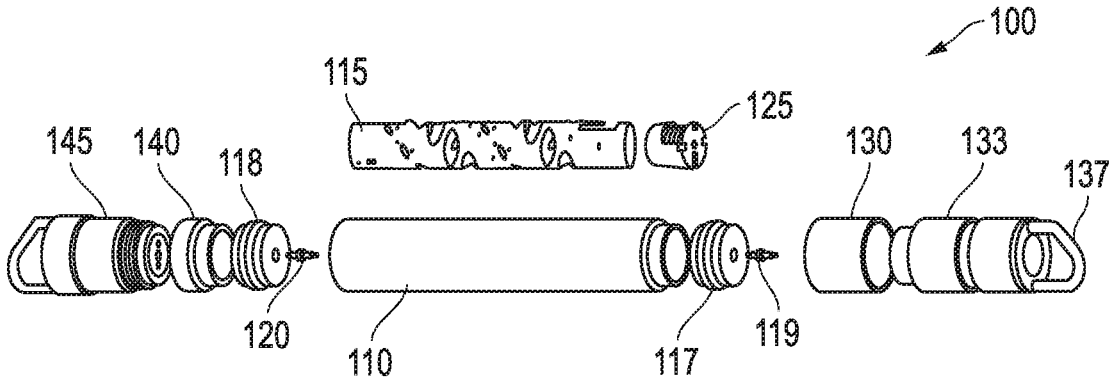
FIG. 1A is an exploded perspective view of an embodiment of a cohesively enhanced modular perforating gun.

Referring now to FIG. 1A, an exploded perspective view of an embodiment of a cohesively enhanced modular perforating gun 100 is shown. In this embodiment, modular components include a carrier 110 that is configured for accommodating a loading tube 115. The loading tube 115 is configured to accommodate a host of shaped charges for a perforating application in a well 180 (see FIG. 1B). However, in the embodiment shown, the loading tube 115 is also configured to accommodate an initiator assembly module 125. That is, rather than utilizing externally wired initiator and detonator components, manually wired to the gun 100 at the oilfield, a single pre-wired initiator assembly module 125 of such functionality may be plugged into the loading tube 115.

As detailed further below, even though plugged in, the module 125 includes safety features to prevent accidental detonation and is provided to the oilfield in an unarmed state. Specifically, with added reference to FIGS. 3A, 3B, and 4A even though the module 125 is outfitted with a detonator 301 coupled to a single pre-wired subassembly package 302, a shutter 479 is provided that prevents full arming of the gun 100. Thus, in order to fully arm the gun 100, a sequenced command is required to displace the shutter 479 and allow the gun 100 to be fired once the proper instruction is placed.

Continuing with reference to FIG. 1A, the carrier 110 and loading tube 115 may be sealed off at either end by bulkheads 117, 118. Thus, explosive shaped charges may be safely isolated within the downhole environment until the time of the perforating application (see FIG. 1B). Further, each bulkhead 117, 118 may have a modular feedthrough 119, 120 to ultimately provide electrically connectivity between internal components such as the initiator assembly module 125 and communications from surface. Thus, signature commands from surface may reach the initiator assembly module 125 to trigger perforating as noted above.

The modular nature of each feedthrough 119, 120 may be rendered reliably secure and practical by the addition of barrel inserts 500 to enhance the interface between electrical connector 530 and a body 580 of the feedthrough 119, 120 (see FIG. 5). Similarly, as also detailed further below, interfacing between the carrier 110 and loading tube 115 may be securely enhanced by the use of one or more centralizing members, such as rings 200 about the loading tube 115 (see FIGS. 2A and 2B). It should be appreciated that other embodiments may employ other centralizing features, such as flanges, standoffs, pegs, protrusions, and so forth, for example.

The above noted bulkheads 117, 118 may also serve as adapters where crossovers 130, 140 may be secured for providing secure communicating connection to other modular components. For example, in the embodiment shown, a plug and shoot module 133 and handling cap 137 are secured to one crossover 130 and may in turn provide connection to a setting tool or other device. However, at the other end, the crossover 140 may couple to a head 145 providing connection to a correlation tool or other device.

Figure 1B:
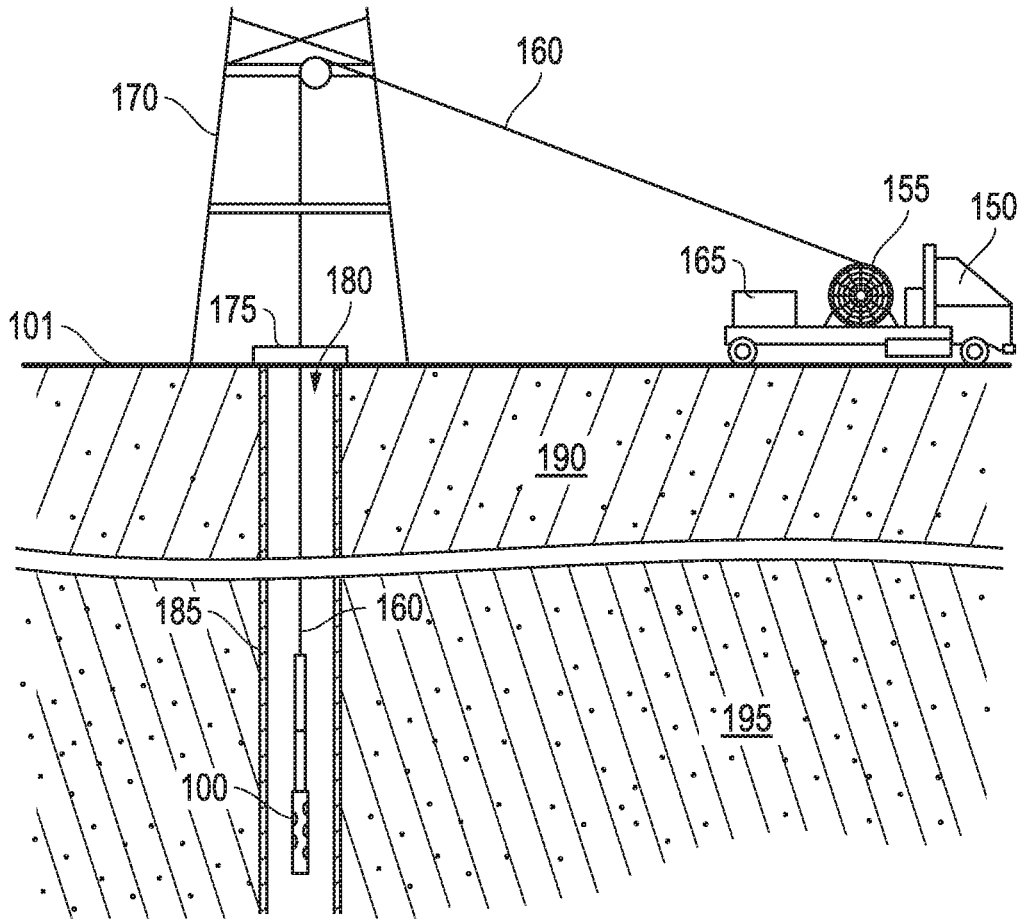
FIG. 1B is an overview of an oilfield with a well accommodating the perforating gun of FIG. 1A.

Referring specifically now to FIG. 1B, an overview of an oilfield 101 is shown with a well 180 accommodating the perforating gun of FIG. 1A. The modular gun 100 may be assembled offsite in a controlled location before delivery to the oilfield 101. Thus, the gun 100, and in particular, the initiator assembly module 125 may be delivered in a pre-wired manner with a detonator 301 in place (see FIG. 3A). As noted above, the module 125 may be armed and/or disarmed once reaching the oilfield. As opposed to challenging manual wiring and/or disconnecting, arming and disarming may take place in a user friendly manner as described above and detailed further herein. With this type of modular gun 100 available, misruns due to manual error in assembly at the oilfield may be eliminated and a manner of rapid deployment provided.

Once armed at the module 125 and secured to a wireline cable 160, the gun 100 may be deployed. As opposed to hours of wiring and assembling time before use in a well, in the embodiment shown, the armed gun 100 may be hooked up, a brief electronics diagnostic check run, and the gun 100 deployed as noted from a reel 155 at a wireline truck 150. Guidance from a control unit 165 and supportive rig 170 may be utilized as the gun 100 is advanced past a wellhead 175 and various formation layers 190, 195 before perforating is directed through casing 185 defining the well 180.

The entire modular gun 100 may be disposable even after a single perforating application as described. That is, the ability to use low-cost modular components that fit multiple gun sizes may minimize concern over disposal of the system after perforating is complete. Thus, time lost to cleaning and refurbishing parts may be largely avoided.

Figure 2A:
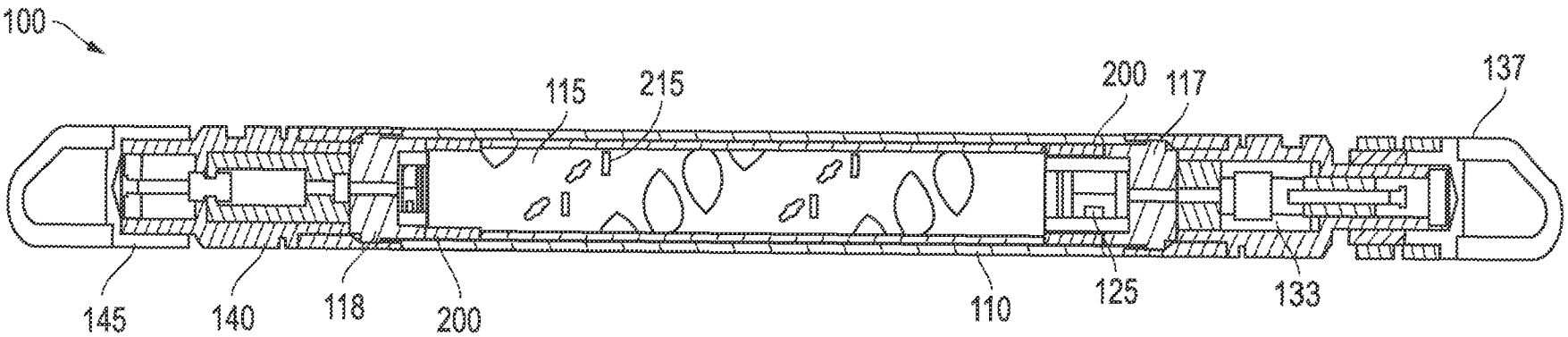
FIG. 2A is a side cross-sectional view of the perforating gun showing chamfered centralizing rings ensuring cohesive fit between a loading tube and carrier.
Figure 2B:
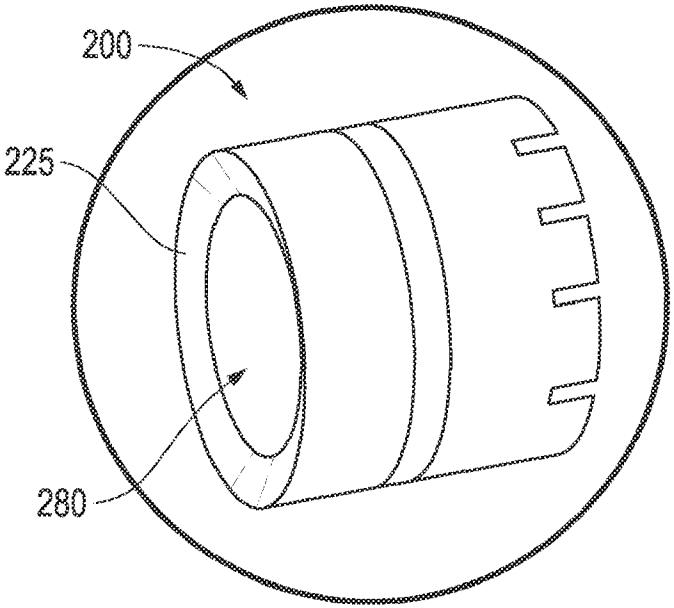
FIG. 2B is an enlarged view of the perforating gun of FIG. 2A revealing detail of a centralizing ring interface between the loading tube and carrier.

Referring now, to FIGS. 2A and 2B, more internal structure of the gun 100 is shown which allows for such reliable and inexpensive modular construction. Specifically, FIG. 2A is a side cross-sectional view of the perforating gun 100 showing chamfered centralizing rings 200 that help to ensure a cohesive fit between the loading tube 115 and carrier 110. These types of rings 200 may also serve as an aid to connector engagement or as standoffs relative more internal shaped charges.

In the view of FIG. 2A, the above referenced modular components of the gun 100 are visible in a fully assembled form. Specifically, the bulkheads 117, 118 are threadably or otherwise secured to crossovers 130, 140 with a feedthrough 119, 120 disposed through each bulkhead 117, 118 to support continuous communicative connection through the gun 100. Continued threadable connection between, and/or among, the crossovers 130, 140 and more distal components of the plug and shoot module 133, handling cap 137 and head 145 allow for an overall modular gun assembly.

In the embodiment shown, the inner surface of the loading tube 115 may include a variety of different fasteners 215 for securing communicative line that traverses the length of the tube 115. That is, given that communications from bulkhead 117 to bulkhead 118 and beyond are wired through the tube 115, it may nevertheless be advantageous to retain such wiring away from certain locations of the loading tube 115 such as at the central axis, at shaped charge locations, etc. Thus, this particular wiring or line may be spiraled through the loading tube 115 and held by securely at predetermined locations by the noted fasteners 215.

Completing the gun 100 by way of joining the bulkheads 117, 118 to the carrier 110 is preceded by loading of the loading tube 115 into the carrier 110 once the initiator assembly module 125 is securely in place. That is, the module 125 is plugged into the loading tube 115, the loading tube 115 inserted into the carrier 110 and the bulkheads 117, 119 secured thereto. Of course, different types of initiator modules may be interchangeably utilized depending on the type of perforating application to be run.

In the embodiment shown, positioning the loading tube 115 into the carrier 110 includes the placement of centralizing rings 200 between the carrier 110 and the loading tube 115 as the two are brought together. The centralizing rings 200 may be of a durable plastic or other suitable material that serve to dampen impacts and vibrations that will occur as the gun 100 is transported or deployed into the well. So, for example, the possibility of damage to electronics of the initiator assembly module 125 within the loading tube 115 may be lessened.

In addition to the protective support provided by centralizing rings 200, they also may be used to ensure a cost-effective and proper sizing match between the loading tube 115 and carrier 110. That is, as opposed to requiring a near perfectly fitted size match between the modular tube 115 and carrier 110 components, centralizing rings 200 may effectively serve to provide the proper size match. That is, even with a host of differently sized loading tubes 115 and carriers 110 available, an inexpensive plastic, but properly sized set of rings 200 may more than adequately serve to provide a matching interface between the modular tube 115 and carrier 110. Additionally, in one embodiment, the rings 200 may be located at an interface between the carrier 110 and a bulkhead 117, 118 or other feature coupled to the loading tube 115. That is, in such an embodiment, the rings 200 would still remain within the carrier 110 while supporting and centralizing the tube 115.

Continuing with added reference to FIG. 2B, at least one end of each centralizing ring 200 is chamfered 225 inwardly. Thus, placement of a ring 200 about the loading tube 115 may be promoted. For example, in one embodiment a ring 200 may be located within the carrier 110 at the end opposite the initiator assembly module 125 with the chamfered end 225 facing the direction of the module 125. The loading tube 115 may then be inserted into the carrier 110 and deflectably guided into position, through the ring orifice 280 by the chamfered end 225 of the ring 200. With the module 125 already loaded into the tube 115 and the centralizing ring 200 already in place thereover, the bulkhead 117 may then be secured to the carrier 110 and the modular gun 100 completed. In one embodiment, the centralizing ring 200 may be chamfered on both ends and not directionally dependent. Additionally, rings 200 may include standoffs supported by the inner wall of the carrier 110 as well as a host of other features.

Figure 3A:
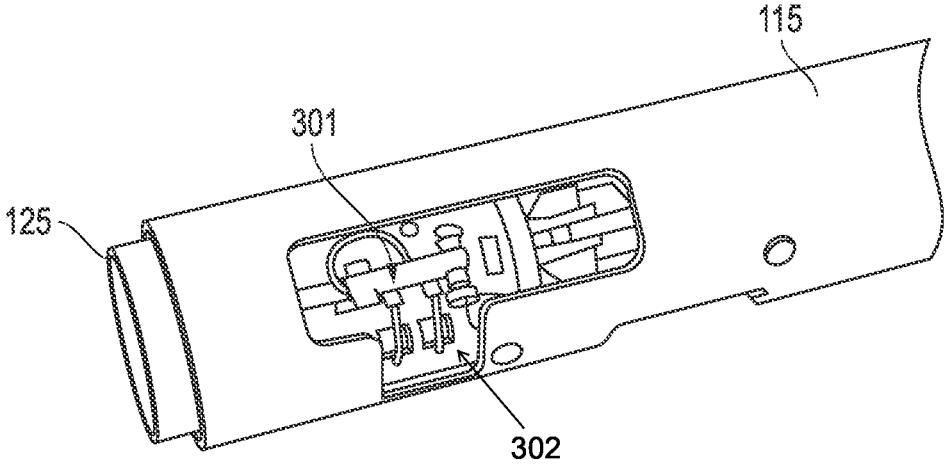
FIG. 3A is a perspective view of an embodiment of an initiator assembly module configured for plugging into the loading tube of FIG. 2A.
Figure 3B:
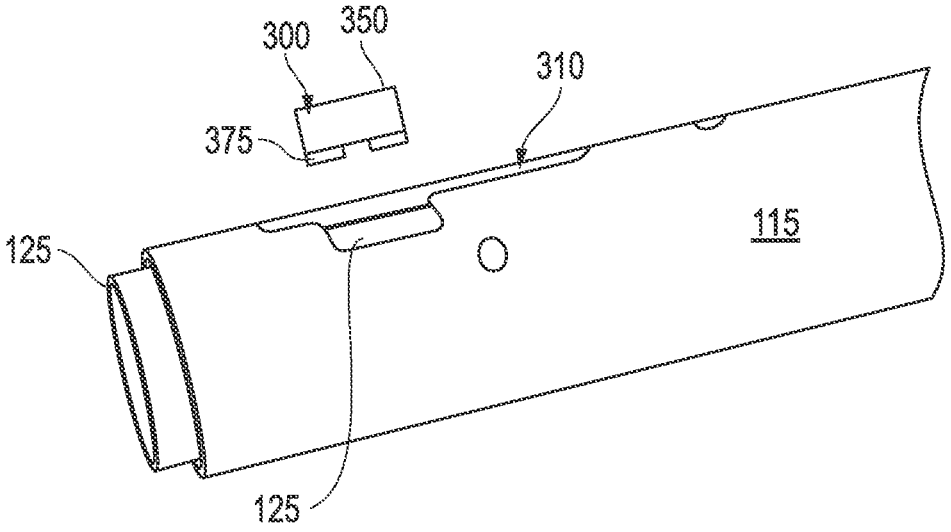
FIG. 3B is a perspective view of the module of FIG. 3A plugged into the loading tube and wired in place utilizing an embodiment of retention clips.

Referring now to FIGS. 3A and 3B, with added reference to FIGS. 1A and 1B, additional features are described which add to the practicality of using a linked together, modular concept for a gun 100 as described. Specifically, as alluded to above, the initiator assembly module 125 affords advantages related to reducing the amount of manual wiring and assembly that takes place at an oilfield 101. It includes features that mitigate the risk of accidental detonation, for example, due to stray voltage. Additionally, while a detonator 101 is provided as part of the module 125, added measures may be taken to ensure proper alignment and retention of the detonator 301 during handling and use of the gun 100.

With specific reference to FIG. 3B, a retaining clip 300 is shown that may be directed toward the initiator assembly module 125 via a cutaway 310 in the loading tube 115. That is, recalling that in the embodiment shown, the module 125 is at least partially inserted into the tube 115, the cutaway 310 in the tube may provide manual access to the module 125 for sake of continued accessibility. For example, in the embodiment shown, a retention clip 300 may be placed through the cutaway 310 to secure permanent retention and engagement of the detonator 301 within the module 125. Thus, detonator movement and misalignment from shock over the course of handling and using the gun 100 may be avoided. Snap-fitting of the clip 300 may involve no more than properly aligning tabs 375 relative the detonator 301 and module body 125. Thus, a user-friendly, sandwich-like engagement of the detonator 301 may be permanently ensured. Additionally, the clip 300 snaps securely into place with an upper surface 350 that is left flush with, or below the outer diameter of the loading tube 115. This manner of snapping into place may include a one direction insertion with the clip 300 keyed such that accidental removal or dislodging is prevented. Therefore, the gun 100 is secure with the clip 300 out of the way.

Figure 4A:
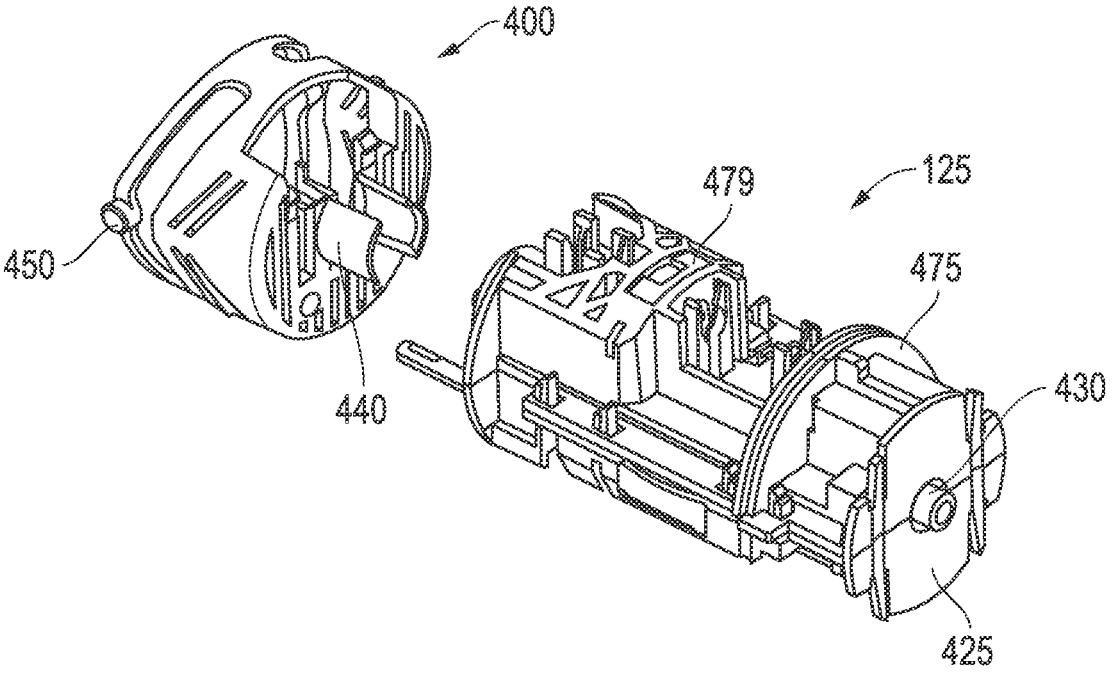
FIG. 4A is a perspective view of a shock absorbing mount for securing in the loading tube to receive the module of FIGS. 3A and 3B.
Figure 4B:
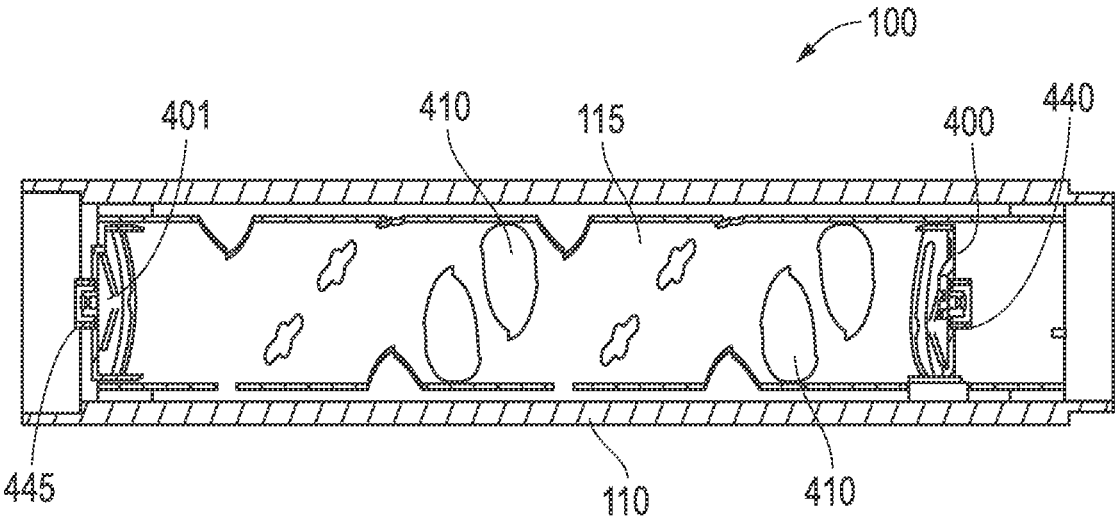
FIG. 4B is a side cross-sectional view of the loading tube within the carrier of FIG. 1A with the mount of FIG. 4A secured therein.

Referring now to FIGS. 4A and 4B, features that allow the initiator assembly module 125 to be securely and stably accommodated in modular form are shown. Recalling that the module 125 operates as a ballistic interrupt with a shutter 479 as a final safety switch to truly arming the gun 100, a degree of structural safety and improving engagement of adjacent connectors is afforded by use of shock absorbing features. Specifically, a shock absorbing mount 400 or connector is shown that may be affixed into position within the loading tube 115. A coupling 440 may be provided for securely receiving the module 125 as it is inserted within the tube 115 and mated thereto. In one embodiment, the spring 450 includes a chamfered engagement member (e.g., a post that may be inserted into an aperture) such that it may also be of enhanced durability during connecting of the module 125 to the mount 400.

As indicated above, the mount 400 is shock absorbing. Specifically, a spring 450 is provided that allows for some degree of stable movement of the mount 400 as the module 125 is forcibly pushed into place. Similarly, allowing this type of movement also helps to prevent disconnect of the module 125 during transport and other times that the gun 100 may be prone to abrupt movement. Indeed, to a certain degree, the module 125 may be less affected by perforating related shock during a downhole perforating application, due to the presence of the shock absorbing mount 400. Further, another shock absorbing mount 401 at the other end of the loading tube 115 may be utilized for receiving another modular gun component at a coupling thereof 445. Thus, the advantages noted here may be available beyond the particular connection of the module 125. These advantages may also include adding flexibility in terms of reducing precision manufacturing requirements and costs due to the added structural flexibility in fitting adjacent components together.

Some embodiments may include positioning the shock absorber and/or the initiator outside of the loading tube. For example, in some embodiments, the shock absorber may be positioned at an end of the loading tube and within a carrier. The initiator may then be positioned adjacent to the shock absorber (e.g., on the end of the shock absorber or beside the shock absorber). Additionally, in some embodiments, the shock absorber may be formed as an integral part of the initiator. That is, the shock absorber may be formed as part of the initiator when the initiator is created.

Continuing with reference to the particular views of FIGS. 4A and 4B, additional features of the loading tube 115 and initiator assembly module 125 are also apparent. For example, the module 125 may include a blast wall 475 to minimize damage adjacent components of the gun 100 which are further uphole thereof as a result of the perforating application. That is, with reference to the loading tube 115 within the carrier 110, explosive forces may emanate from the shaped charge locations 410 during perforating. However, the blast wall 475 may be strategically located to absorb such explosive forces and prevent damage to other modular components of the gun 100 that are further uphole (e.g. via the bulkhead 117 of FIG. 1A). In one embodiment, the blast wall 475 may be sacrificial plastic. However, other types of blast wall construction may be utilized. In the view of FIG. 4A, an electrical connection 430 is shown that emerges from the face 425 of the module 125 for connection to a feedthrough 119 as detailed further below.

Figure 5A:
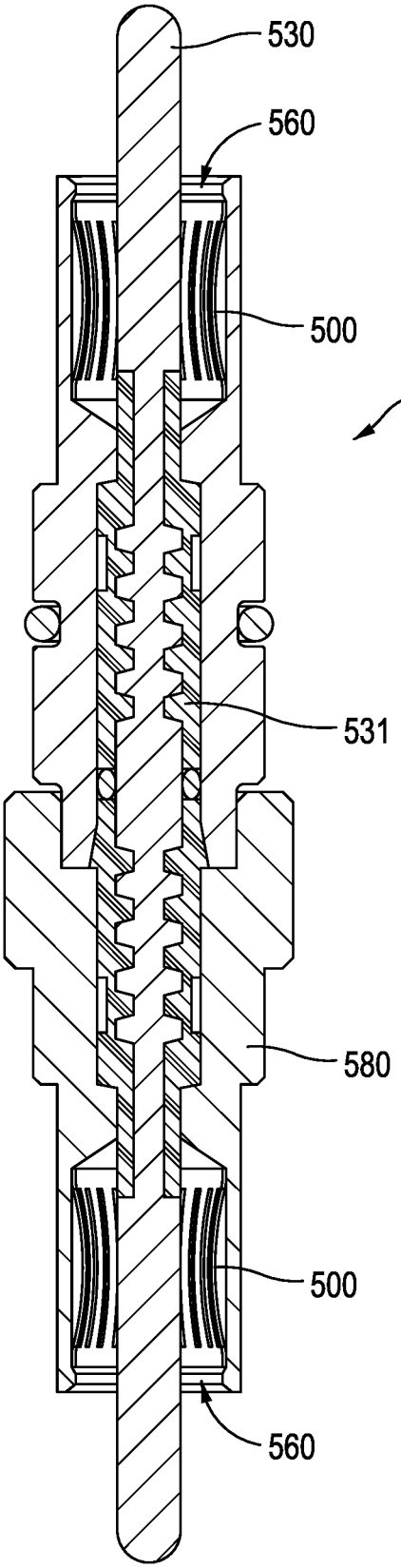
FIG. 5A is a side cross-sectional view of an embodiment of a modular feedthrough assembly for coupling a bulkhead to the initiator assembly module of FIGS. 3A and 3B.
Figure 5B:
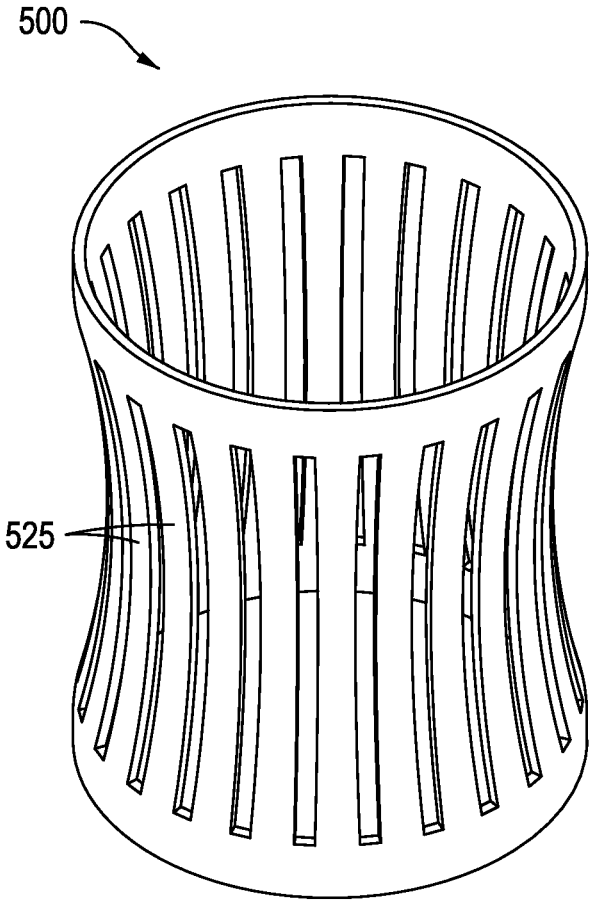
FIG. 5B is a perspective view of an embodiment of a compressible barrel insert of the feedthrough assembly of FIG. 5A to enhance the coupling between the bulkhead and initiator assembly module.

Referring now to FIGS. 5A and 5B components of a modular feedthrough 119 are depicted. Specifically, FIG. 5A is a side cross-sectional view of a feedthrough 119 which serves as both a pressure barrier and electrical connector. To this end, the feedthrough 119 also serves as a structural coupling from the initiator assembly module 125 through a bulkhead 117 such as that of FIG. 1A. FIG. 5B is a perspective view of a barrel insert 500 of the feedthrough for securing a connector 530. Specifically, barrel inserts 500 may be housed within cavities 560 of the feedthrough 119 for securing the connecter 530 therethrough. For example, the connector 530 may be of an outer diameter that is slightly larger than the inner diameter of the barrel insert 500. Thus, bow springs 525 that define the inner diameter of the barrel insert 500 may forcibly deflected outwardly to a degree as the connecter 530 is tightly engaged thereby. Ultimately, this means that a secure ground contact is maintained with secure resistance to movement of the connector 530 is provided in either direction, for example, during transport or delivery of the gun 100 of FIG. 1A.

With added reference to FIG. 4B, the connector 530 may be secured to the electrical connection 430 of the initiator assembly module 125 and to a crossover 130 at another end thereof (see FIG. 1A). Thus, a body portion 580 of the feedthrough 119 provides structural support for the electrical path that runs from the module 125 and through the feedthrough 119. In one embodiment, the connector 530 is largely plastic that is molded over a central electrical pin. This can be seen in FIG. 5A, where a member 531 is disposed between the body portion 580 and the electrical connector 530. Therefore, a secure and reliable connection is provided that is also cost-effective.

Embodiments described hereinabove include a perforating gun that may be assembled from modular components. At the same time, however, the overall gun is of an axially enhanced cohesiveness among the components so as to ensure reliability in delivery and use downhole. From barrel inserts at a feedthrough to more centrally located rings and/or shock absorbing mounts, substantially enhanced axial cohesiveness is provided to render a modular perforating gun practical in terms of both cost and reliability. More specifically, an initiator assembly module is utilized that may be disposed at least partially within a loading tube that is itself within a carrier. However, as a matter of ensuring cohesiveness, centralizing rings may be disposed at the interface of the loading tube and carrier and the initiator module may incorporate a detonator and avoid use of excessive external wiring. Similarly, a feedthrough with barrel inserts may be utilized along with other cohesively enhancing features. This type of gun allows for avoidance of large open ports for sake of time consuming, manual wiring while exposed to the hazards and contaminants of the oilfield and natural human error. At the same time, this gun type is also rendered practical by the use of cohesively enhancing features as described.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A modular perforating gun for perforating a subsurface formation, the gun comprising:

a tubular carrier;

a loading tube within the carrier to accommodate shaped charges;

at least one centralizing member removably positioned within the tubular carrier and separate from the loading tube, wherein the centralizing member separably contacts both the tubular carrier and the loading tube at one distal end of the loading tube to provide an interface between the tubular carrier and the loading tube;

at least one bulkhead within the carrier to fluidly seal either end of the loading tube;

an initiator assembly module separably and removably located at least partially within the loading tube to trigger the charges for the perforating, the initiator assembly module comprising a pre-wired sub-assembly package and a detonator; and a modular feedthrough separably disposed through the at least one bulkhead to provide a pressure barrier and electrical connectivity between the initiator assembly module and communications from the surface, the modular feedthrough comprising a body and an electrical connector, and a member disposed between the body and the electrical connector.

2. The modular perforating gun of claim 1 wherein the modular feedthrough for the bulkhead has at least one barrel insert within a cavity thereof for securing the electrical connector coupled to the initiator assembly module.

3. The modular perforating gun of claim 1 wherein the centralizing member comprises a ring that is chamfered inwardly.

4. The modular perforating gun of claim 1 wherein the centralizing member is configured to dampen vibrations through the gun.

5. The modular perforating gun of claim 1 wherein the initiator assembly module comprises a blast wall for shielding the bulkhead from the shaped charges.

6. The modular perforating gun of claim 1 further comprising a barrel insert comprising deflectable bow springs defining an inner diameter thereof.

7. The modular perforating gun of claim 1 further comprising a shock absorbing mount secured to the loading tube for receiving the initiator assembly module therein and further enhancing axial cohesiveness of the modular gun.

8. The modular perforating gun of claim 1 further comprising a shock absorbing mount secured to the loading tube and integral to the initiator assembly module.

9. The modular perforating gun of claim 1 wherein a snap-fit retention clip couples the detonator with the initiator assembly module.

10. The modular perforating gun of claim 1, wherein the initiator assembly module further comprises a shutter to prevent full arming of the perforating gun.

11. The modular perforating gun of claim 1, wherein the electrical connector is a single electrical connector that is a unitary member disposed through the body from end to end thereof.

12. A modular perforating gun comprising:

a tubular carrier;

a loading tube within the carrier;

a shock absorbing mount separably positioned within the loading tube at one distal end of the loading tube;

an initiator assembly module separably positioned axially within the tubular carrier adjacent the shock absorbing mount and secured to the shock absorbing mount, wherein the shock absorbing mount structurally stabilizes the connection between the initiator assembly module and the loading tube, and wherein the initiator assembly module comprising a detonator;

at least one centralizing member for providing an interface between the tubular carrier and the loading tube at least one of the distal ends of the loading tube; and a modular feedthrough having at least one barrel insert within a cavity thereof for securing an electrical connector coupled to the initiator assembly module.

13. The modular perforating gun of claim 12 wherein the shock absorbing mount comprises a chamfered engagement member for reinforcably receiving the initiator assembly module.

14. The modular perforating gun of claim 12 wherein the initiator assembly module is of a pre-wired configuration and the detonator further comprises enhanced security thereto by a snap-fit retention clip.

15. The modular perforating gun of claim 12, wherein the initiator assembly module further comprises a shutter to prevent full arming of the perforating gun.

16. A method of assembling a modular perforating gun, the method comprising:

inserting a chamfered radially centralizing member into and within a tubular carrier, the centralizing member removably positioned within the tubular carrier;

positioning a loading tube for the gun within the tubular carrier such that the chamfered radially centralizing member contacts both the tubular carrier and the loading tube at one distal end of the loading tube to provide an interface between the tubular carrier and the loading tube, the centralizing member being separate from the loading tube;

inserting a substantially pre-wired initiator assembly module for the gun into the loading tube, the loading tube having a cutaway on its outer surface, the initiator assembly comprising a detonator;

installing a shock absorbing mount within the loading tube;

plugging the initiator assembly module into the shock absorbing mount during connection to the loading tube, the shock absorbing mount for structurally enhancing coupling between the initiator assembly module and the loading tube; and inserting a bulkhead within the carrier to seal a distal end of the loading tube.

17. The method of claim 16 further comprising directing a snap-fit retention clip through the cutaway to enhance security of the detonator to the initiator assembly module to allow a perforating application with shaped charges to be accommodated by the loading tube.

18. The method of claim 17 wherein the snap-fit retention clip is keyed for one direction insertion to retain the detonator and prevent accidental dislodging thereof.

19. The method of claim 16 further comprising securing an electrical connector through the loading tube to fasteners at an inner wall thereof.

20. The method of claim 16 further comprising:

delectably guiding the loading tube to position within the carrier with the aid of the chamfered centralizing member.

21. The method of claim 16 further comprising coupling an electrical connector of the initiator assembly module to a modular feedthrough for the bulkhead, the feedthrough having at least one barrel insert within a cavity thereof for securably receiving the electrical connector during the coupling thereof.

22. The method of claim 16 further comprising disposing of the modular gun after a single perforating application.

23. The method of assembling the modular perforating gun of claim 16, wherein the initiator assembly module further comprises a shutter to prevent full arming of the perforating gun.

* * * * *